US005398458A

United States Patent [19]

Henriksen et al.

[11] Patent Number: 5,398,458

[45] Date of Patent: Mar. 21, 1995

[54] PROCESS OF MANUFACTURING STONE TILE MOSAICS AND APPARATUS THEREFOR

[75] Inventors: Lars E. Henriksen, Buffalo Grove; Steven R. Austin, Winnetka; Ronald S. Allen, Palatine; Michael J. Sutfin, Mundelein, all of Ill.

[73] Assignee: Craftsman Marble, Granite & Tile Co., Lake Forest, Ill.

[21] Appl. No.: 978,862

[22] Filed: Nov. 19, 1992

[51] Int. Cl.[6] ..... B24B 27/06; B28D 1/04

[52] U.S. Cl. ..... 451/41; 52/311.1; 125/13.01; 125/35; 451/58

[58] Field of Search ..... 125/13.01, 35, 12; 51/283 R, 327; 52/311.1, 311.2, 314, 315

[56] References Cited

U.S. PATENT DOCUMENTS

| | | | |
|---|---|---|---|
| 3,807,095 | 4/1974 | Harding | 125/35 |
| 3,809,050 | 5/1974 | Chough et al. | 125/35 |
| 4,407,262 | 10/1983 | Wirz et al. | 125/13.01 |
| 4,688,540 | 8/1987 | Ono | 125/13.01 |

FOREIGN PATENT DOCUMENTS

| | | | |
|---|---|---|---|
| 0516066 | 10/1954 | Belgium | 125/13.01 |
| 4206274 | 9/1992 | Germany | 125/35 |

*Primary Examiner*—Robert A. Rose
*Attorney, Agent, or Firm*—Wallenstein, Wagner & Hattis, Ltd.

[57] ABSTRACT

The present invention generally relates to a process of and apparatus for manufacturing tile mosaics from at least two stone slabs, such as marble or granite slabs. The process comprises the steps of: a) cutting each of the two slabs into a matrix of pieces while maintaining the original orientation of the pieces, b) classifying the pieces of each matrix into two or more sets of pieces, c) intermixing a first set of pieces of one slab with a second set of pieces of another slab while maintaining the original orientation of the pieces, thereby forming the mosaic. The cutting apparatus comprises: a) a platen having a resilient layer for supporting the slab, b) a gantry table saw having a plurality of blades and a rotatable table for supporting the platen, and c) a hold-down rack for securing the slab and platen during cutting. At least two grippers are use to intermix at least one set of pieces from one slab with at least one set of pieces from a second slab to form the mosaic. By mixing the color shades and grain patterns of several different stone slabs, a mosaic having a handset look is achieved. Adjacent rows of the newly formed mosaic matrix may be offset to further enhance the handcrafted appearance of the mosaic.

20 Claims, 4 Drawing Sheets

PROCESS OF MANUFACTURING STONE TILE MOSAICS AND APPARATUS THEREFOR

TECHNICAL FIELD

The present invention pertains to a process of and apparatus for manufacturing tile mosaics made from stone slabs having varying shades of color and grain or veining patterns.

BACKGROUND PRIOR ART

Architects and interior designers have long recognized the durability and beauty of finishing floors and walls of a building with stone tile. Stone tile finishes take on even greater beauty when arranged in mosaic form. To create the mosaic, many slabs of stone are cut into small pieces of tile. The tile pieces are typically randomly mixed together during the cutting process. The individual tiles are then shipped to a job site and secured to the walls or floors of a building. The mixed tile pieces create a handcrafted look by blending together the differently shaded tile pieces and the grain patterns of individual stone slabs.

One problem in creating tile mosaics is that during installation each tile must be secured to a wall or floor piece-by-piece. This process is time consuming and labor intensive. A worker can typically only install 2.5 square feet of mosaic tile per day. This creates tremendous logistic problems at the work site, especially when the tile mosaic is installed at or near a main entrance of the building.

To reduce job site logistics problems, the tile pieces can be secured to a backing sheet prior to shipment. The sheets of tile can then be secured to the floor or wall more quickly. Unfortunately, each tile piece must still be secured to the backing sheet piece-by-piece. The same labor intensive and time consuming process is still required.

An additional problem is that the stone tiles cannot be cut very small, especially when the aspect ratio of the tile is close to that of a cube. For example, marble is commonly available in $12\times12\times\frac{3}{8}$ inch (30 cm$\times$30 cm$\times$1 cm) slabs. Yet, the only known commercially produced marble mosaic has tile pieces cut to about $19/32\times19/32\times\frac{3}{8}$ inches.

The present invention is provided to solve these and other problems.

SUMMARY OF THE INVENTION

The present invention generally relates to a process of and apparatus for manufacturing tile mosaics from at least two stone slabs, such as marble or granite slabs. The process comprises the steps of: a) cutting each of the two slabs into a matrix of pieces while maintaining the original orientation of the pieces, b) classifying the pieces of each matrix into two or more sets of pieces, and c) intermixing a first set of pieces of one slab with a second set of pieces of another slab while maintaining the original orientation of the pieces, thereby forming the mosaic. The cutting apparatus comprises: a) a platen having a resilient surface for supporting the slab, b) a gantry table saw having a plurality of blades and a rotatable table for supporting the platen, and c) a hold-down rack for securing the slab to the platen during cutting. At least two grippers are use to intermix at least one set of pieces from one slab with at least one set of pieces from a second slab to form the mosaic. By mixing the color shades and grain or veining patterns of several different stone slabs, a tile mosaic having a handset look is achieved. Adjacent rows of the newly formed mosaic matrix may be offset to further enhance the handcrafted appearance of the mosaic.

One advantage of the present invention is that it provides a means for cutting two or more stone slabs into pieces while maintaining the original uncut orientation of each slab. This enables the pieces of one slab to be readily intermixed with the pieces of another slab. The process enables a single worker to readily intermix sets of tile pieces and secure those sets to a backing sheet, thereby minimizing the cost of producing the tile mosaic.

A further advantage of the present invention is that it provides a means for intermixing the tile pieces of different stone slabs while maintaining the original matrix of the pieces of each slab. By maintaining the original matrix of a first set of pieces of one slab when placed on a backing sheet, a second set of pieces from a subsequent slab having the same matrix can be placed between the pieces of the first set to produce a new matrix of intermixed pieces.

A still further advantage of the present invention is that the process and apparatus work when the tile pieces have a high aspect ratio such as that of a cube. The pieces are not prone to tip over and disrupt the original orientation of the pieces of each slab.

Other features and advantages of the invention will be apparent from the following specification taken in conjunction with the following drawing.

DETAILED DESCRIPTION

Figure 1:
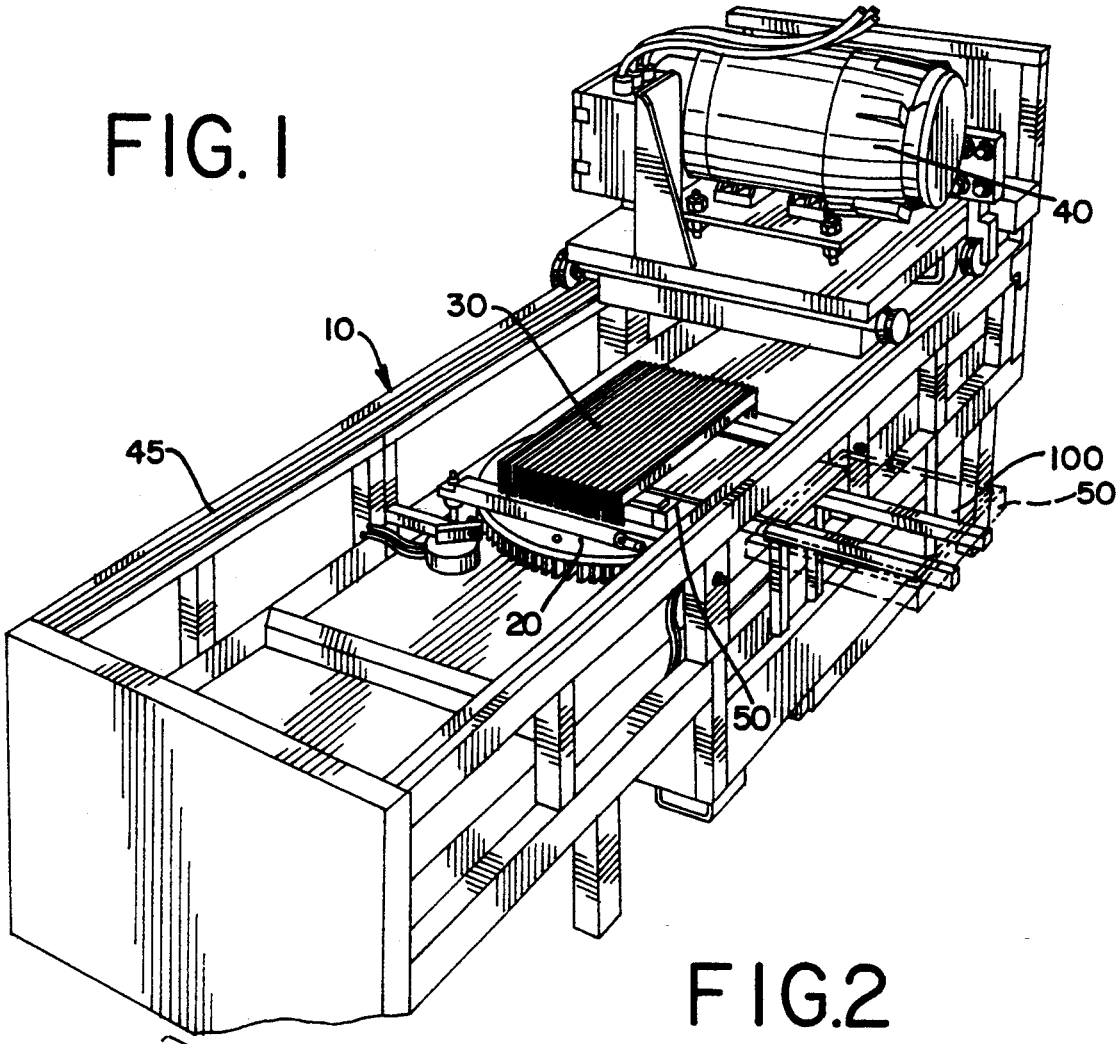
FIG. 1 is a perspective view of a gantry table saw having a rotatable table and a hold-down rack, with phantom lines showing a platen and stone slab being inserted between the table and the rack.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 2:
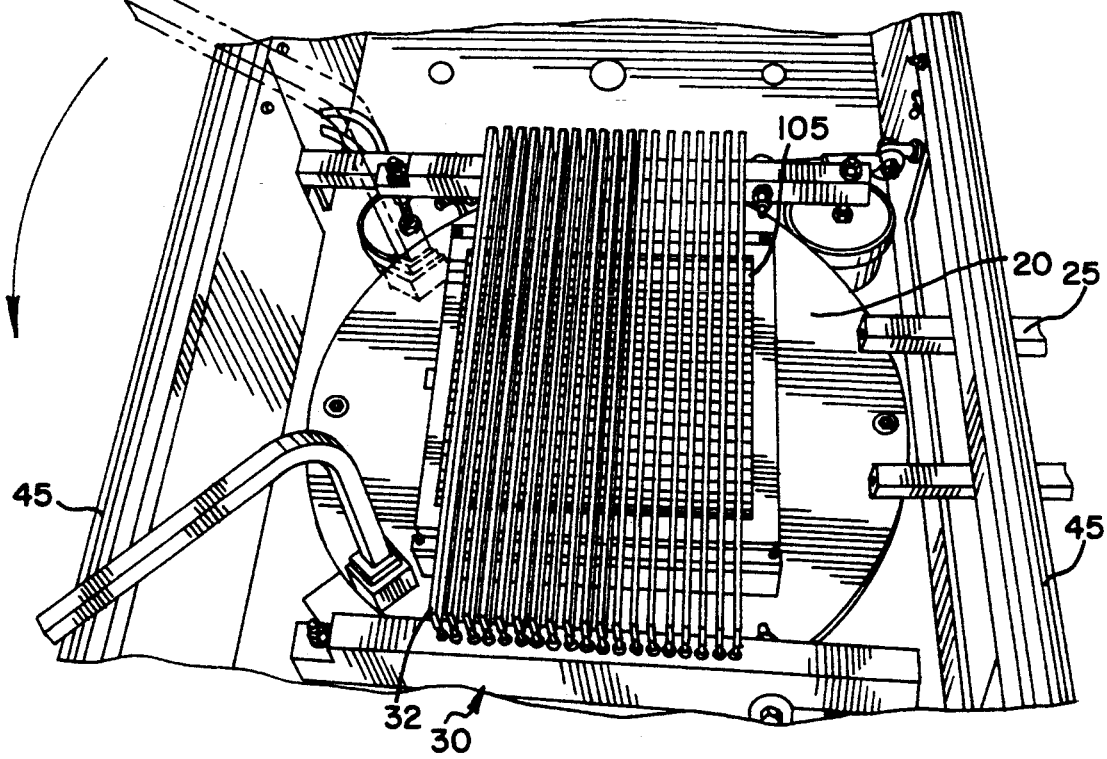
FIG. 2 is a top perspective view of a rotatable table and hold-down rack engaging a platen and stone slab already cut into strips, with phantom lines showing the table rotated from a first to a second position.

FIGS. 1 and 2 show a motor driven gantry type table saw 10 having a rotatable table 20, a hold-down rack 30, a carriage 40 and a track 45 upon which the carriage moves. Twenty-four blades (not shown) are mounted on a 1.750 inch diameter shaft housed by the carriage. The carriage also houses a motor (not shown) for driving the carriage along track 45 and rotating the shaft.

When a 12×12×⅜ inch marble slab 100 is being cut into 7/16 inch wide strips 105, the table saw should be equipped with twenty-four eight inch blades and powered by a 25 horse power motor. This produces 23 strips which can be cut into 529 tile pieces 109. The ⅛ inch wide beveled edges of the marble are disposed of as waist. Optimal cutting of a ⅜ inch thick marble slab 100 is believed to require at least 1 horse power per 8 inch blade. This achieves a cutting rate of 5200 surface feet per minute, and a maximum cutting speed of 6.19 linear feet per minute. An 8 inch×0.060 inch wet cutting blade with bronze bonding agent and 28% concentration of industrial diamond produces the optimal cut.

As shown in FIG. 1, the stone slab 100 is manually loaded onto a platen 50. The platen 50 has a 14×14 inch upper surface to accommodate the stone slab 100. Platen 50 is preferably ¾ inch thick and made of thermally conductive aluminum to facilitate the removal of the heat generated during the cutting process.

A compressible resilient layer 60 (FIG. 4) is secured to the surface of platen 50. This layer 60 helps prevent slab 100 from moving during the cutting process. Layer 60 is preferably a urethane sheet secured to platen 50 with 100% epoxy. A suitable resilient layer 60 can be purchased from Gallagher Corporation of Gurnee, Ill. as black urethane Model No. 55A.

Resilient layer 60 is provided with grooves 62 (FIG. 3) with a carbide tipped saw blade. The grooves 62 follow the exact channels of the 24 blades. Here, the grooves are arranged into perpendicular rows and columns because the slabs are being cut into square pieces 109. The grooves 62 allow a water spray (not shown) to keep the blade cool below the cut of the stone slab 100. The grooves 62 also allow water to flow away from a base of the stone 100 which is critical to keeping the original orientation of the slabs 110 during the cutting process. The grooves 62 also allow the small particles of chipped stone or debris to be washed away from the cut pieces.

After the marble slab 100 has been loaded onto platen 50, the platen and slab are positioned on rotatable table 20 under hold-down rack 30 (FIG. 1). Table 20 is rotated into a first position that aligns the stone slab 100 and the platen grooves 62 with the blades. The table 20 can be locked into this positions by any acceptable means, such as a set screw. Hold-down rack 30 consists of twenty-four steel bars or rails 32 aligned to receive one blade between adjacent pairs of rails.

A resilient strip (not shown) is fitted on the underside of each hold-down rail 32. These resilient strips prevent movement of the stone slab 100, strips 105 and pieces 109 during the cutting process. Each resilient strip is preferably made of hard rubber and formed into a "V" shape. A tip of the "V" engages the stone. This keeps water from accumulating between the marble and the resilient strips and hold-down bars 32. The accumulation of water between the hold-down bars 32 and strips 105 or tile pieces 109 can cause the pieces to move when the hold-down rack 30 is raised. Such movement is unacceptable intermixing the pieces 110 into mosaic form.

When table 20, platen 50 and slab 100 are aligned with the carriage blades, hold-down rack 30 is pneumatically lowered to a pre-determined position. Hold-down rack 30 holds slab 100 securely in place against platen 50, and platen 50 securely against table 20 in preparation for the first cut. The hold-down rack 30 also helps to hold the table 20 in place.

When the table saw is activated, the carriage 40 begins to move down track 45. When the blades engage the stone slab 100 water is automatically applied to the cutting area. Twenty-four streams of water (not shown) are directed toward the area where saw blades meet the stone. The water spray rate is controlled by a variable speed switch which also optimizes the cutting rate of stones for varying hardness ratings. All water is contained within the system and a double-tiered waste handler is used to settle and remove sledge from the water.

Figure 4:
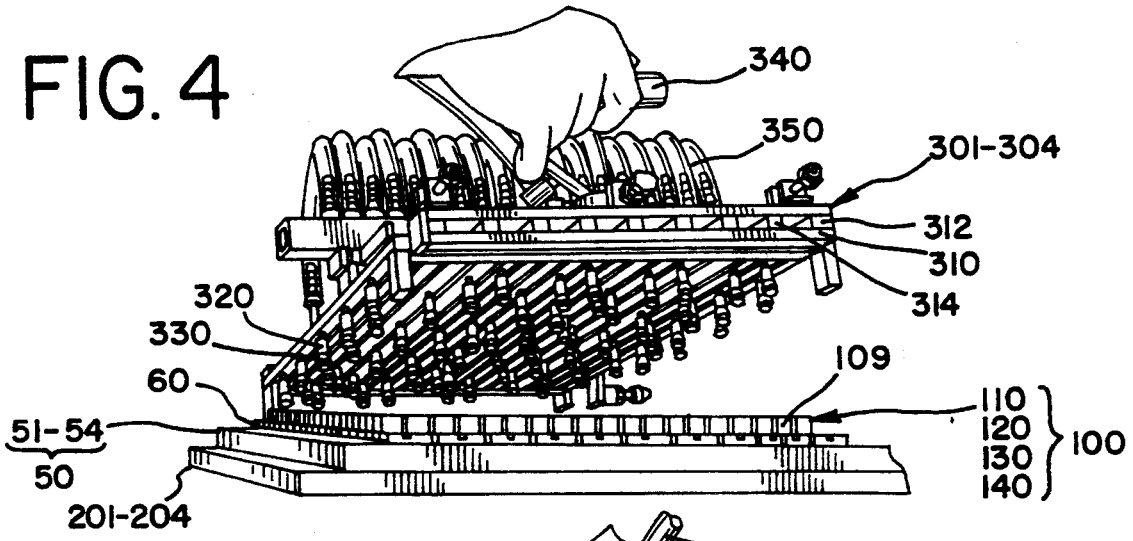
FIG. 4 is a side view showing a first gripping means positioned over a cut slab and aligned to grip a first set of pieces of a marble slab.

The first cut leaves 23 strips of stone 105 (FIG. 2), each approximately 12 inches long and 7/16 inches wide. After the first cut is completed, a high pressure jet of air is directed between the bars 32 and stone strips to remove any stagnant water left on the stone and grooved platen layer 60 (FIG. 4). A surfactant is then sprayed on the bars 32 to prevent water from forming a vacuum between them and the stone strips 105. The hold-down rack 30 is then pneumatically raised to release the platen 60, stone strips 105 and table 20. Table 20 is then manually rotated 90 degrees to a second predetermined position to align the stone strips 105 with the blades for a second cutting pass.

Hold-down rack 30 is again pneumatically lowered in preparation for the second cut. The saw carriage 40 is pneumatically raised onto pulleys positioned over the cutting track 45 and manually returned to the starting position. A second cut is made by passing the saw carriage 40 over stone strips 105. After this cut is complete, 529 individual pieces 109 (FIG. 3) remain clamped in place. The high pressure jet of air is once again used to remove stagnant water and a surfactant is applied to reduce the surface tension of the water. The hold-down rack 30 is then raised and the platen is slid out manually on hard plastic rails 25, as shown in phantom lines in FIG. 1.

The table saw 10 can be equipped with a second cutting station to speed up the cutting process. This second station is located further down the track and includes a second rotatable table 20 and hold-down rack 30. The identical cutting process is repeated at the second station on a second stone slab. The second station speeds up the cutting process because the insertion, rotation and removal steps can be performed at the first station while the blades are cutting a slab 100 at the second station and visa versa.

Figure 3:
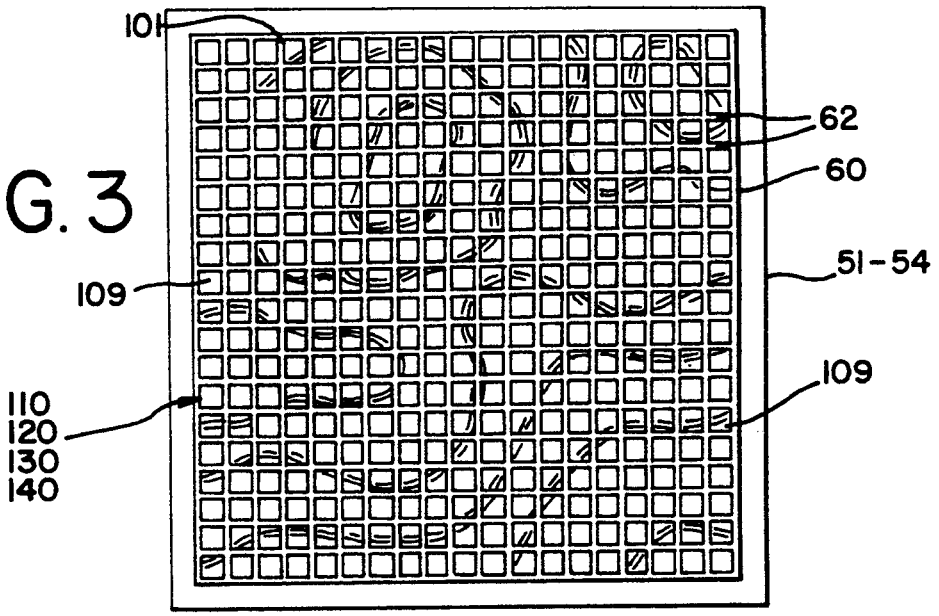
FIG. 3 is a perspective view of a platen supporting a stone slab cut into a matrix pieces, the pieces being in their original orientation.

As shown in FIG. 3, the stone slab 100 has been cut into a perfect rectilinear matrix of tile pieces 109. The pieces 109 remain in the same pre-cut position and orientation as in the pre-cut slab 100. No lateral movement of the pieces 109 has occurred. As will be discussed later, it is critical to the mosaic forming process that the exact original position and orientation of the pieces 109 be maintained throughout the cutting process. The grain or veining pattern of the marble slab 109 is still readily apparent in the tile pieces 109.

The cutting process is preferably performed on four separate stone slabs. Each slab is cut into four separate matrixes 110, 120, 130 and 140 of pieces 109. Each matrix is a duplicate of the others. The individual pieces 109 making up each matrix are located in exactly the same position and have exactly the same orientation as the pieces in the other matrixes. Although, in this description, four stone slabs are being intermixed to form four tile mosaics, it should be understood that any number of slabs could be intermixed. In addition, although, the four matrixes 110–140 are described as being duplicates of each other, it should be understood that the broad aspect of the invention could utilize one matrix having a greater number of pieces 109 than another matrix, as long as the pre-intermixed positions and orientations of the pieces are the same.

Figure 7:
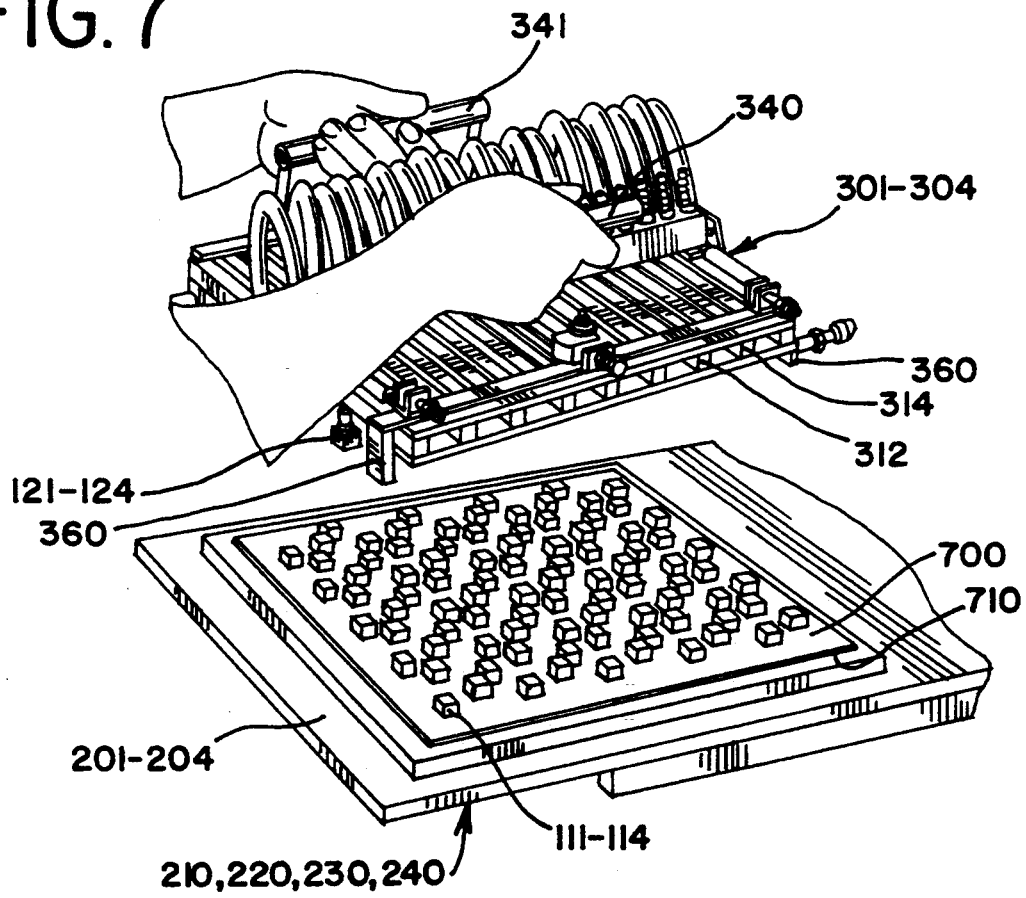
FIG. 7 is a perspective view of a first set of pieces of a first marble slab adhered to a backing sheet with a second gripping means aligning a second set of pieces of a second marble slab for placement on the backing sheet between the first set of pieces.

One platen 51, 52, 53 or 54 holding one matrix 110, 120, 130 or 140 (FIG. 4) is placed at each of four sub-station 210, 220, 230 and 240 of an assembly table 201, 202, 203 or 204 (FIG. 7). Each table should rotate so a worker will have access to all four sub-stations without moving. Each stone slab matrix is classified into four sets of pieces 111–114, 121–124, 131–134 and 141–144 respectively, as shown in Table 1 and FIG. 8.

TABLE 1

| Original Matrix | Is Formed by predetermined sets of pieces | | | |
|---|---|---|---|---|
| 110 | 111 | 112 | 113 | 114 |
| 120 | 121 | 122 | 123 | 124 |
| 130 | 131 | 132 | 133 | 134 |
| 140 | 141 | 142 | 143 | 144 |

The tile pieces 109 classified to comprise set 111 are equivalent to the pieces classified to comprise sets 121, 131 and 141. Each set 111, 121, 131 and 141 is formed by pieces 109 having the same respective locations in their respective matrix 110–140. Similarly, sets 112, 122, 132 and 142 are classified to comprise equivalent pieces 109. The same applies for sets 113,123, 133 and 134 and sets 114, 124, 134 and 144.

Four grippers 301, 302, 303 and 304 (each like that shown in FIG. 6) are used to intermix the above sets of pieces to form four new mosaic matrixes 410, 420, 430 and 440 of pieces. One possible way of intermixing mosaic matrixes 410–440 is shown in Table 2.

TABLE 2

| Mosaic Matrix | Is Formed by predetermined sets of pieces | | | |
|---|---|---|---|---|
| 410 | 111 | 122 | 133 | 144 |
| 420 | 112 | 123 | 134 | 141 |
| 430 | 113 | 124 | 131 | 142 |
| 440 | 114 | 121 | 132 | 143 |

A first gripper 301 grips and moves sets 111, 121, 131 and 141 to one of said sub-stations. A second gripper 302 grips and moves predetermined sets 112, 122, 132 and 142, to another sub-station etc. Each gripper 301–304 grips approximately 25% of the original matrix 110, 120, 130 and 140 of each stone slab 101–104. The four grippers 301–304 combine to intermix each original stone slab matrix 110, 120, 130 and 140 to form new mosaic matrixes 410, 420, 430 and 440 at the four different sub-stations as shown in Table 2.

As shown in FIG. 4, each gripper 301–304 is comprised of a frame 310, a plurality of parallel steel tubes 320, a plurality of suction cups 330 and a right and left handle 340 and 341. The frame 310 positions its suction cups 330 to engage one of the above sets of pieces. The cups 330 should be spaced apart so they do not pick up adjacent pieces 110. One suction cup 330 is fixed to one end of each tube 320. The other end of each tube 320 is rigidly secured to frame 310. The cups 330 should not move laterally with respect to each other. The suction cups 330 should be urethane and preferably of the type sold by Stilson, a division of Stocker & Yale, Inc. of Frasor, Mo. as green urethane Model No. VCB10 with 10–32 m fittings.

Each gripper 301–304 is connected to a vacuum supply (not shown). The vacuum supply can be achieve by two vacuum pumps powered by a seven horse power air compressor. The vacuum pumps should provide a maximum vacuum pressure of 27 inches of mercury. Such pumps are available from PIAB as Model M25OD. The vacuum pumps communicate with grippers 301–304 through flexible hose 350. A standard manually operated ball valve (not shown) can be used to open and close the vacuum supply to grippers 301–304. Twenty-one inches of mercury must be provided to each gripper 301–304 and suction cup 350 during the moving process to ensure the pieces 110 will not drop.

Figure 5:
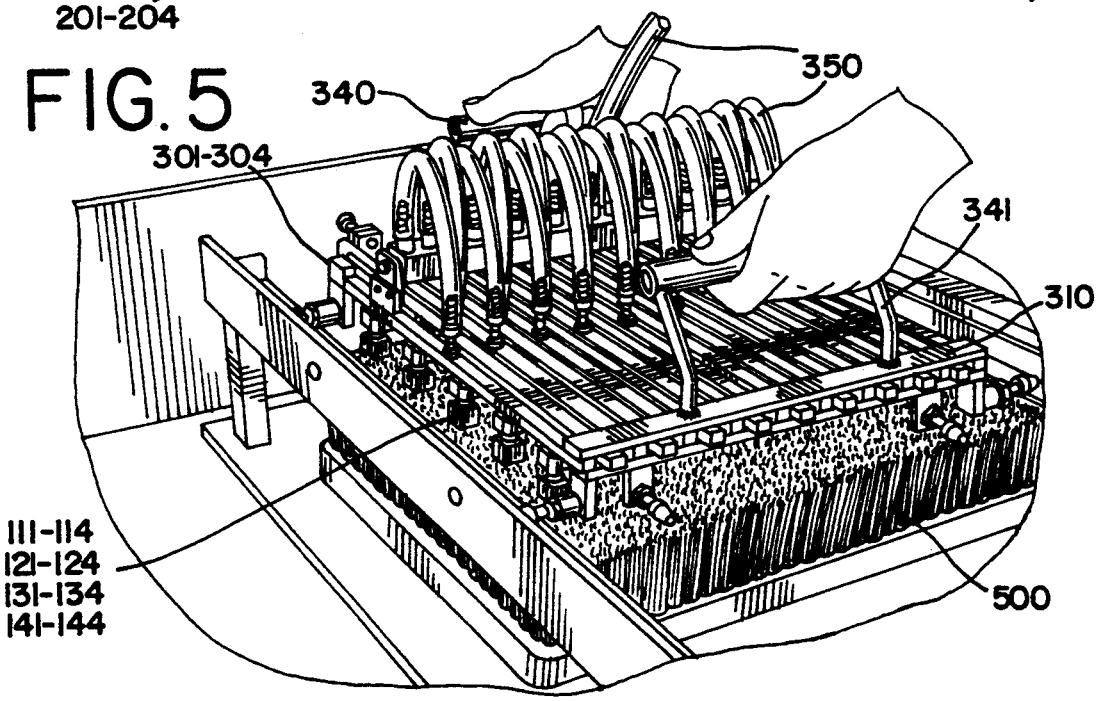
FIG. 5 is a perspective view of a gripping means passing a set of gripped pieces over a brush.

Before being delivered to one of the sub-stations, each set of pieces like 111 are passed through a cleaning rack 500 as shown in FIG. 5. Cleaning rack 500 removes any small chipped particles clinging to the individual tesserae pieces 109. The tolerance between pieces 109 is typically half of the width of the cutting blade, or about 0.031 inches. Chips of about that size can prohibit successful alignment and placement of the sets of pieces 111, 122, 133 and 144. As previously stated, it is critical to the mosaic forming process that the exact original position and orientation of the pieces 109 be maintained throughout the cutting process. If any one of the pieces of the first set of pieces 111 does not set flat or is not in perfect alignment, the remaining sets of pieces 122,133 and 144 will not be able to drop into place. Subsequent grippers cannot then be lowered into proper position if chips misalign even one tesserae 109 of a prior drop.

Figure 6:
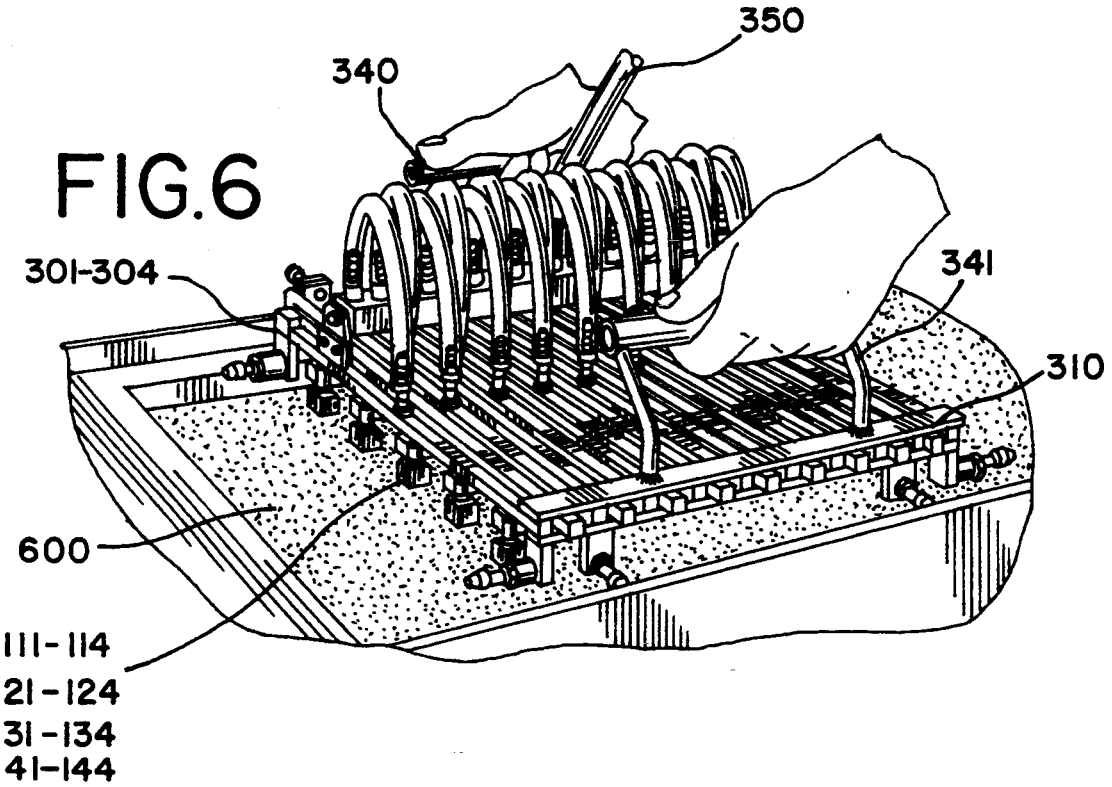
FIG. 6 is a perspective view of a gripping means applying an adhesive to a set of gripped pieces.

After cleaning, each set of predetermined pieces like 111 are dipped into a glue mixture 600, as shown in FIG. 6. The glue is preferably 3M #30 Fast Bond/Neutral mixed in a carpet-type weave material so that the glue is dispersed equally onto the bottom surfaces of the pieces 111.

Each gripper then places the set of pieces like 111 on a backing sheet 700 like that shown in FIG. 7 resting on table 201, 202, 203 or 204 at one of the sub-stations 210, 220, 230 or 240. These sets of pieces are manually positioned onto backing sheet 700 by one of the grippers 301, 302, 303 or 304 with the aid of positioning pins 360. The vacuum-pressure to the gripper involved and its suction cups 330 is then turned off.

Each backing sheet 700 has a specially formulated fiberglass mesh backing made for use with enhanced/-modified thin set mortar cements, and separated with a tough mylar plastic sheet to prevent damage to the surface during shipping. The mylar used in the backing sheet 700 is preferably a 0.004 inches thick layer of clear polyester film, such as Hostaphan Model No. 4400. Pre-placed under each backing sheet 700 is a releasable sheet 710. Releasable sheet 710 is preferably mylar and coated with a silicon release agent to facilitate separating it from the backing sheet 700 prior to installation.

Figure 8:
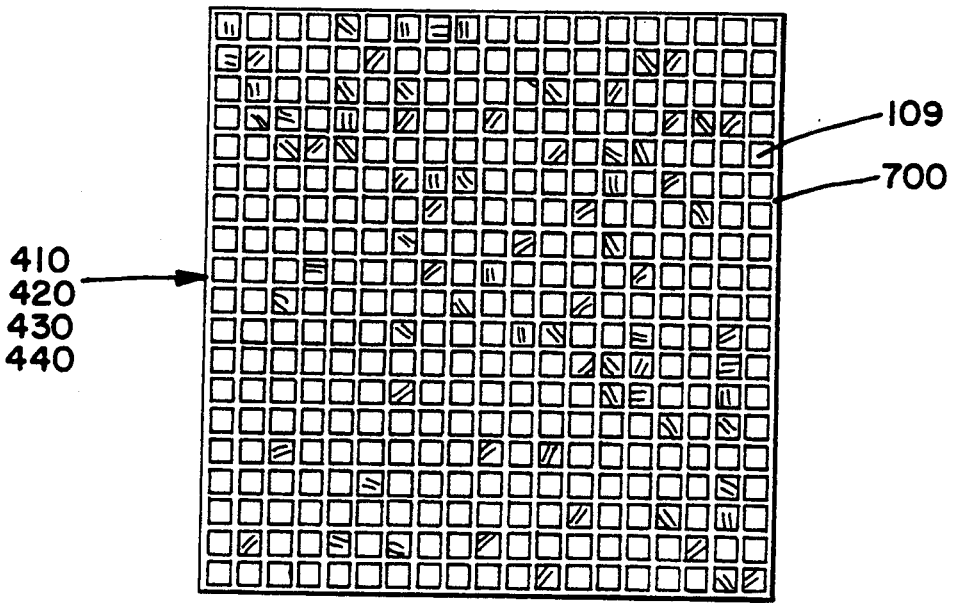
FIG. 8 is a top view of a newly formed matrix of intermixed pieces having their original orientation.

After the first set of pieces 111 is secured to a backing sheet 700, a second gripper like 302 moves, cleans, and applies glue to a second set of pieces 122 for matrix 120 as described. As shown in FIG. 7, the gripper 302 is again manually positioned over backing sheet 700 with the aid of positioning pins 360. Mosaic matrix 410 is completed by gripping, moving, cleaning and applying glue to the third and fourth sets of pieces 133 and 144, and placing them into their respective locations between the pieces 111 and 122 already on backing sheet 700. The new mosaic matrix 410 of intermixed sets of pieces is shown in FIG. 8. The same process is then used to create three additional mosaic matrixes 420, 430 and 440 of intermixed sets of pieces. Grippers 301–304 are typically set to align all sets of tesserae 109 square and parallel to one another.

Figure 9:
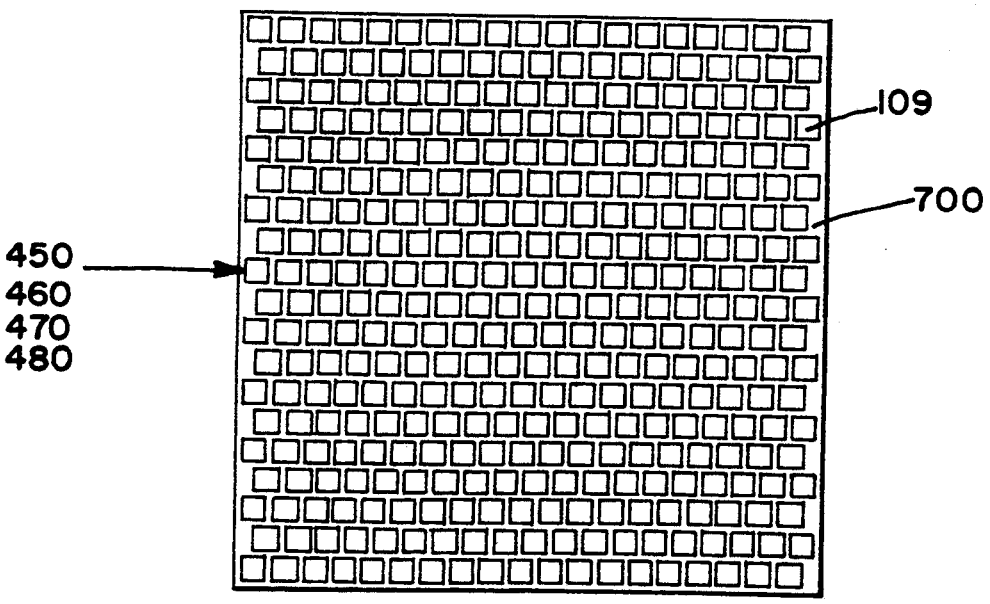
FIG. 9 is a top view of a newly formed matrix of intermixed pieces having an off-set orientation.

In another embodiment, grippers 301–304 can be adapted to arrange the intermixed sets of pieces in an offset mosaic matrix 450, 460, 470 or 480, as shown in FIG. 9. The frame 310 of each platen 301–304 is thus comprised of two interlocking racks 312 and 314 shown in FIG. 4. Every other row of steel tubes 320 is secured to a different interlocking rack 312 or 314. The right handle 340 is pivotally attached to one rack 312 and engages the other rack 314. When the handle 340 is pivoted a predetermined distance, the interlocking racks 312 and 314 offsets one interlocking rack 312 with respect to the other interlocking rack 314. This offsets adjacent rows of tubes 320 and suction cups 330, as well as the tile pieces 120 secured to them. Each set 111–114, 121–124, 131–134 and 141–144 of tesserae pieces is offset exactly the same predetermined distance prior to placing the set on the backing sheet 700. A typical offset is roughly one half the width of the tile pieces 109. This offset pattern enhances the handcrafted appearance of the tile mosaic.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A process of manufacturing a mosaic comprising the steps of:

providing at least a first and a second thin pre-cut veneer tile;

securing said first veneer tile using a hold-down rack with cutter-receiving clearance slots therein; cutting said first thin pre-cut veneer tile in two orthagonal directions through said slots to form at least a first initial matrix of tesserae pieces having at least a first and a second group or set of tesserae pieces, while maintaining said tesserae pieces of said first initial matrix in their original positions by use of said hold-down rack; securing said second veneer tile using the same or similar slotted hold-down rack therein; and cutting said second thin pre-cut veneer tile in two different orthagonal directions through said slots to form at least a second initial matrix of tesserae pieces having at least a third and a fourth group or set of tesserae pieces respectively positioned and sized like said first and second group or set of tesserae pieces, while maintaining said tesserae pieces of said second initial matrix in their original positions by use of said latter hold-down rack; and, simultaneously gripping outer portions of said first group or set of said first initial matrix with a carrier structure and moving the carrier structure and first group or set of tesserae pieces gripped thereby to a first delivery location and depositing said tesserae pieces thereupon in a manner where the bottom surfaces of the tesserae pieces are in the same or similar positions they occupied on said carrier structure, and then releasing said carrier structure from said tesserae pieces;

then simultaneously gripping outer portions of said fourth group or set of tesserae pieces of said second initial matrix with a carrier structure and moving the carrier structure and the fourth group or set of tesserae pieces gripped thereby to said first delivery location in a manner where the bottom surfaces of the tesserae pieces are in the same or similar positions they occupied on said carrier structure and wherein said tesserae pieces will be positioned to be interleaved with said first group or set of tesserae pieces transferred thereto, and then releasing said carrier structure from said tesserae pieces, to form a first mosaic matrix of at least said two groups or sets of tesserae pieces.

2. The process of claim 1, wherein said tesserae pieces of said mosaic matrix have the identical positions they occupied in the original initial matrix.

3. The process of claim 1, wherein said tesserae pieces of said mosaic matrix have positions offset from their original positions in the initial matrix from which they were obtained.

4. A process of forming a mosaic from at least a first tile and a second tile, said process comprising the steps of: first cutting said first tile into a first initial matrix of tesserae pieces, each of a similar size and kept in the same position they occupied in the uncut tile, and then cutting said second tile into a second initial matrix of pieces corresponding to the tesserae pieces of the first tile and kept in the same position they occupied in the uncut tile, selecting from said first initial matrix at least a first multiplicity of tesserae pieces creating a first set having a defined configuration;

selecting from said second initial matrix at least a second multiplicity of tesserae pieces creating a second set having another defined configuration non-superimposable with the first set; and simultaneously moving with a carrier structure said first multiplicity of tesserae pieces without disturbing said configuration to a first delivery location where the bottom surfaces thereof are in their carried positions; releasing the grid and contact of said carrier structure with said first multiplicity of tesserae pieces; and simultaneously moving with carrier structure said at least second multiplicity of tesserae pieces without disturbing said configuration to said first delivery location where the bottom surfaces thereof are in their carried positions and interleaved with said first multiplicity of tesserae pieces to form a mosaic pattern of different tesserae pieces cut from at least said first and second tiles.

5. The process of claim 1, wherein said delivery location is on the top of a releasable horizontally oriented and supported backing sheet to which the mosaic matrix is attached to be transportable therewith to a use location.

6. The process of claim 5, further comprising the steps of removing any remaining debris from the bottom surfaces of said tesserae pieces gripped by said carrier structure before the pieces are deposited at said delivery location, and applying a coat of adhesive to said bottom surfaces of said tesserae pieces prior to placing said tesserae pieces on said backing sheet.

7. The process of claim 1, wherein said cutting steps comprise the steps of cutting said tiles into strips, rotating said strips, and transversely cutting said strips into tesserae pieces.

8. The process of claim 4, wherein the first and second tiles are thin pre-cut veneer tiles having different shades of color and different grain patterns, the different shades of color and grain patterns being intermixed in said mosaic of tesserae.

9. The process of claims 1 or 7, further comprising the steps of directing a cooling medium and a surfactant onto said tiles during said cutting steps, and blowing said cooling medium off said tesserae pieces prior to said releasing steps.

10. The process of claims 1 or 8 wherein said first and second thin pre-cut veneer tiles respectively have stone veneers of different shades of color and different grain patterns so that the first and fourth group or set of tesserae pieces of said first and second initial matrices forming the second and third group or set of tesserae pieces of said first and second initial matrices have different shades of color and grain patterns.

11. The process of claim 1, wherein said second initial matrix is a duplicate of said first initial matrix.

12. A process for forming tesserae pieces from a square tile by cutting the tile into strips and the strips transversely into tesserae pieces, the process comprising the steps of:

providing a platen with a compressible top surface with grooves defining parallel channels extending into transverse directions, and means for cutting said tile, said cutting means including cutting blades and a table;

placing said tile on the compressible top surface of said platen and said platen on said table;

securing said tile upon said platen and said platen to said table using a hold-down rack having parallel rails defining parallel slots therebetween through which said cutter blades pass and cut through the tile supported on the platen therebelow, the bottom of said rails having compressible strips which engage the top surface of the tile therebelow;

forcing the hold-down rack with said compressible strips at the bottom thereof upon the upper surface of the tile to press the tile upon the compressible surface of the platen and to press the platen against said table, the platen positioned so that a set of parallel channels in the top surface of said platen are aligned with the slots in said hold-down rack;

cutting said material into strips by passing said cutting blades through said hold-down rack slots and cutting through the tile held in place by the hold-down rack and directing cooling water upon the surface of the tile as it is being cut by said cutting blades;

releasing said platen and tile strips therein by raising said hold-down rack and then rotating said table 90° wherein the strips cut from the tile extend at right angles to their initial positions and another group of channels in top surface of the platen are aligned with the slots of said hold-down rack when lowered upon the tile, and resecuring said platen and strips while maintaining the original orientation of said strips again forming said hold-down rack against the tile strips therebelow and which once again secures the previously cut strips to the platen and the platen to the table, a set of parallel channels on the top surface of said platen then being aligned with their slots in the hold-down rack;

cutting said strips into tesserae pieces by passing the cutting blades through the slots in said hold-down rack and cutting through the tile therebelow and directing cooling water upon the surface of the tile as it is being cut by said blades; and, releasing said platen carrying the cut tesserae pieces from said table while maintaining the original orientation of said tesserae pieces on said platen by raising said hold-down rack therefrom.

13. The process of claim 12, further comprising the steps of directly a surfactant with said cooling medium onto said tile during said cutting steps, and blowing said cooling medium and surfactant off said tesserae pieces prior to said releasing steps.

14. The process of claim 4 wherein the carrier structure for simultaneously gripping or moving each of said first and second multiplicity of tesserae pieces has suction elements on each carrier structure which grip the top surfaces of said tesserae pieces.

15. The process of claim 4 wherein the carrier for the first and second multiplicity of tesserae pieces grip the upper portions thereof; and the process further comprises the steps of removing any debris from the bottom surfaces of the multiplicity of tesserae pieces gripped by said carrier structure before being deposited on said support surface area; and applying a coat of adhesive to the bottom surfaces of the tesserae pieces gripped by the carrier structure prior to delivery of the tesserae pieces to said delivery location.

16. The process of claim 1 wherein the process includes the additional steps of simultaneously gripping the outer portions of said second group or set of tesserae pieces of said first initial matrix with a carrier structure and moving the same to a second delivery location and depositing the tesserae pieces thereat in the positions they occupied on said carrier structure and then releasing said carrier structure from said tesserae pieces; and then simultaneously gripping the outer portions of said third group or set of tesserae pieces of said second initial matrix with a carrier structure and moving the tesserae pieces gripped thereby to said second delivery location and depositing the tesserae pieces thereto in the positions they occupied on said carrier structure and wherein said third group of tesserae are positioned between said second group or set of tesserae pieces and then releasing said carrier structure from said tesserae pieces to form a second mosaic matrix of at least two groups or sets of tesserae pieces.

17. The process of claim 1, wherein said cutting steps are carried out by a table saw structure including cutter blades and a horizontal table over which the cutter blades are moveable in the slots of said hold-down rack, said hold-down rack having parallel rails defining parallel slots therebetween through which said cutter blades pass and cut through the tile therebelow, the bottom of said rails having compressible strips which engage the tile; and the process further comprises the steps of providing a horizontal platen having a compressible top surface, securing the tile in a horizontal position on the top surface of said platen and said platen to said table prior to cutting said strips by forcing the hold-down rack upon said tile, after cutting said strips raising said hold-down rack and then rotating said table with the platen therein to a position at right angles to its initial position, resecuring said platen to said table by lowering the hold-down rack upon the tile prior to cutting said strips into tesserae pieces and, after cutting said strip into tesserae pieces, releasing said platen from said table by raising said rack so that the platen with the cut tile thereon can be moved to a location where the tesserae pieces are moved by said carrier structure.

18. The process of claim 17 wherein the compressible top surface of said platen has grooves which extend at right angles, so that the grooves can be aligned with the slots of said hold-down rack in either one of the two positions of said table, and during the cutting of the tiles directing a cooling medium through the slots of the hold-down rack, the grooves carrying the water and debris from the situs of the tile.

19. The process of claims 1 or 4 wherein said tiles are of a thickness no greater than about $\frac{3}{8}''$.

20. The process of claim 4 wherein said delivery location is a movable support surface to which the bottom surfaces of said tesserae pieces are adhered when deposited thereon.

* * * * *